US009914509B1

(12) United States Patent
Tegeder

(10) Patent No.: US 9,914,509 B1
(45) Date of Patent: Mar. 13, 2018

(54) WAKE ENHANCER

(71) Applicant: Wakesurf Edge, LLC, Winchester, CA (US)

(72) Inventor: Troy Tegeder, Winchester, CA (US)

(73) Assignee: Wakesurf Edge, LLC, Winchester, CA (US)

( * ) Notice: Subject to any disclaimer, the term of this patent is extended or adjusted under 35 U.S.C. 154(b) by 0 days.

(21) Appl. No.: 15/267,015

(22) Filed: Sep. 15, 2016

(51) Int. Cl.
*B63B 35/85* (2006.01)
*B63B 1/20* (2006.01)

(52) U.S. Cl.
CPC ..... *B63B 35/85* (2013.01); *B63B 1/20* (2013.01); *B63B 2035/855* (2013.01)

(58) Field of Classification Search
CPC ..... B63B 35/85; B63B 2035/855
USPC ..... 114/271, 286
See application file for complete search history.

(56) References Cited

U.S. PATENT DOCUMENTS 3,180,604 A * 4/1965 Hammer ..... G03B 42/025 248/205.8
4,846,429 A * 7/1989 Scheurer ..... F16B 47/00 248/205.8
5,715,876 A * 2/1998 Burt ..... B63B 25/082 114/343
6,154,929 A * 12/2000 Dwyer ..... B63B 17/00 16/422
9,296,447 B1 * 3/2016 Morgan ..... B63B 1/28
9,422,028 B2 * 8/2016 Wilhelm ..... B63B 1/32
9,643,695 B1 * 5/2017 Breaux ..... B63B 35/7926
2008/0105800 A1 * 5/2008 Menning ..... B63B 23/62 248/200
2016/0059934 A1 * 3/2016 Wilhelm ..... B63B 1/32 114/271
2017/0233038 A1 * 8/2017 Clover ..... B63B 1/22 114/286

* cited by examiner

*Primary Examiner* — S. Joseph Morano
*Assistant Examiner* — Jovon E Hayes
(74) *Attorney, Agent, or Firm* — Kirton McConkie; Brian Tucker

(57) ABSTRACT

A wake enhancer can be configured to be quickly and easily coupled to and decoupled from a boat even when the boat is in water and without requiring any modification/alteration to the boat. The wake enhancer can include a base, an arm that extends from the base to form a forward facing surface for diverting the flow of water, and opposing sidewalls that extend between the base and the arm to provide support to the arm. The wake enhancer can also include suction cup assemblies that are integrated into the base and function to couple the wake enhancer to the hull of a boat. The opposing sidewalls can include recessed ends which facilitate access to handles of the suction cup assemblies to in turn facilitate coupling and decoupling the wake enhancer.

21 Claims, 13 Drawing Sheets

WAKE ENHANCER

CROSS-REFERENCE TO RELATED APPLICATIONS

N/A

BACKGROUND

Wakesurfing is a sport in which an individual rides the wake of a boat without being directly pulled by the boat. Most boats do not naturally produce a wake that is suitable (e.g., large enough and/or with a smooth enough face) for surfing. Therefore, a number of different devices and techniques have been created to modify the wake that is produced by a boat. For example, ballast (or weight) may be added to one side of the boat to cause it to ride lower in the water. Although reasonably effective, weighting the boat in this manner is dangerous since the boat will be much more likely to take on water or even capsize. It can also be difficult to drive a boat while it is listed to one side. Additionally, when using ballast, switching which side the surfer will ride on can be a very tedious process since the ballast will need to be emptied from the one side and then filled on the other.

To address the downsides of using ballast to produce a suitable wake, some wake enhancing devices have been created. These wake enhancers are typically in the form of a device that attaches to one side of the boat towards the stern. Although the exact mechanism by which such devices enhance the wake is beyond the scope of this specification, suffice it to say that such devices alter the flow of water around one side of the boat thereby enhancing the wake on the opposite side of the boat.

There are a number of downsides to the various wake enhancing devices currently available. For example, it can be difficult to secure these devices to the boat—especially in a manner that may not require permanent alteration/damage to the boat.

BRIEF SUMMARY

The present invention extends to a wake enhancer that is configured to be quickly and easily coupled to and decoupled from a boat even when the boat is in water and without requiring any modification/alteration to the boat. In this way, the wake enhancer of the present invention can be coupled to a desired side of the boat in any suitable location or orientation.

In one embodiment, a wake enhancer can include: a base having a front end and a rear end; an arm extending outwardly and rearwardly from the base, the arm forming a forward facing surface for diverting the flow of water when the wake enhancer is coupled to a boat; opposing sidewalls that extend between the base and the arm to provide support to the arm, the opposing sidewalls being positioned towards the front end of the base; and one or more suction cup assemblies that are secured to the base and configured to couple the wake enhancer to a hull of a boat.

In another embodiment, the wake enhancer can include: a base having a front end and a rear end; an arm extending outwardly and rearwardly from the base, the arm forming a forward facing surface for diverting the flow of water when the wake enhancer is coupled to a boat; opposing sidewalls that extend between the base and the arm to provide support to the arm; and one or more suction cup assemblies, each suction cup assembly comprising: a suction cup positioned below the base; a handle extending through the base; and an engagement lever positioned above the base, the engagement lever configured to pivot with respect to the handle between and engaged and a disengaged position.

In another embodiment, the wake enhancer can include: a base having a front end and a rear end; an arm extending outwardly and rearwardly from the base, the arm forming a forward facing surface for diverting the flow of water when the wake enhancer is coupled to a boat; opposing sidewalls that extend between the base and the arm to provide support to the arm, the opposing sidewalls having recessed ends; and one or more suction cup assemblies, at least one of the suction cup assemblies being positioned rearwardly from the recessed ends, each suction cup assembly comprising: a suction cup positioned below the base; a handle extending through the base; and an engagement lever positioned above the base, the engagement lever configured to pivot with respect to the handle between and engaged and a disengaged position.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

FIGS. 1A-1F illustrate various views of a wake enhancer 100 that is configured in accordance with embodiments of the present invention. Wake enhancer 100 comprises a body formed of a base 101, an arm 102 that extends upwardly/outwardly at an angle (e.g., at a 45° angle) from base 101, and opposing sidewalls 103*a*, 103*b* that extend between a portion of base 101 and arm 102. Wake enhancer 100 further comprises two suction cup assemblies 151, 152 that are integrated into base 101 such that suction cups 151*a*, 152*a* are positioned under base 101 thereby allowing wake enhancer 100 to be coupled to a boat.

Figure 1A:
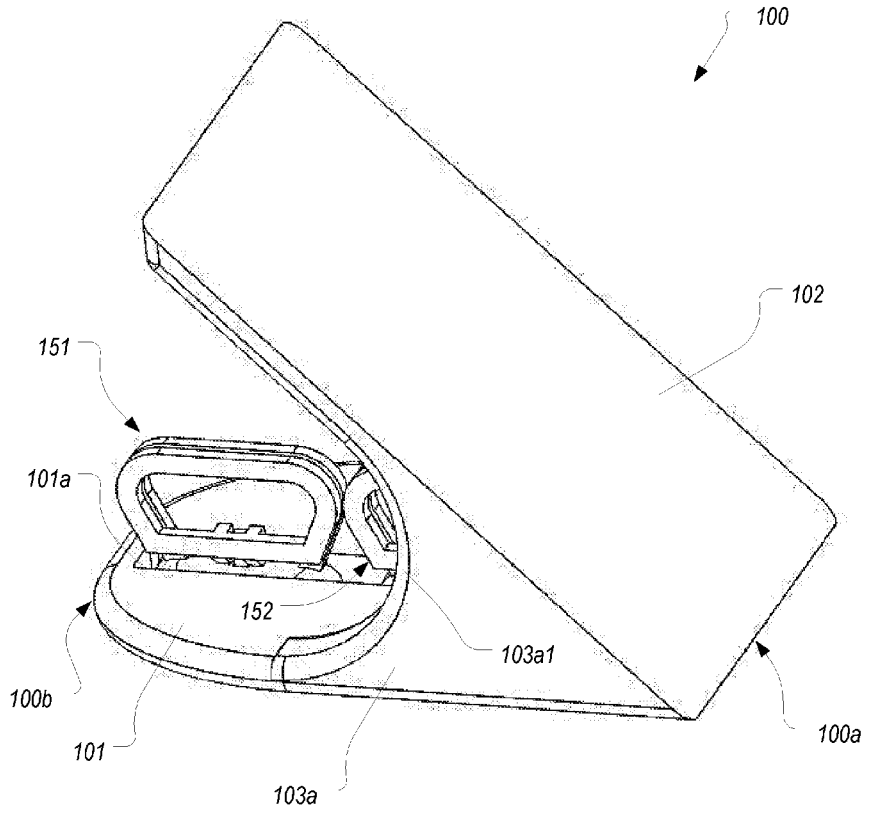
FIGS. 1A-1F illustrate various views of a first embodiment of a wake enhancer.
Figure 1B:
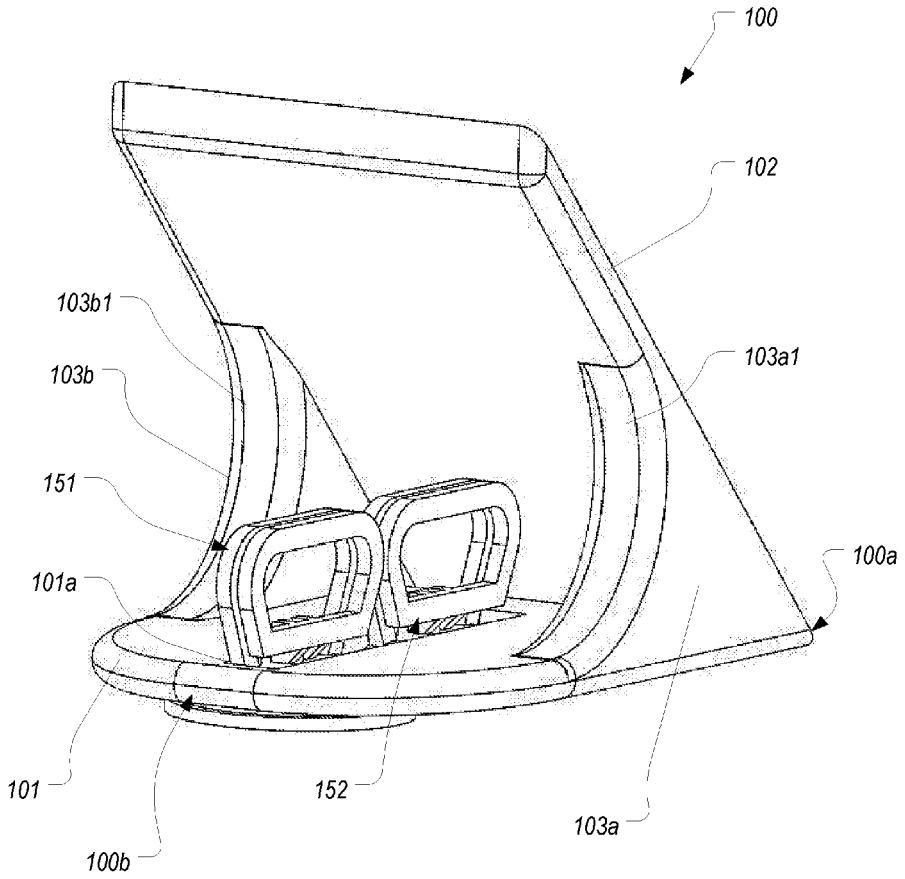

Base 101 can extend between a front end 100*a* and a rear end 100*b* of wake enhancer 100. In this context, "front" refers to the fact that wake enhancer 100 is intended to be coupled to a boat with front end 100*a* facing the front of the boat. Arm 102 emanates from base 101 at front end 100*a* such that arm 102 forms a forward facing surface that extends outwardly from the boat's hull in a rearward direction when wake enhancer 100 is coupled to the hull. Wake enhancer 100 is intended to be coupled to the hull below the water surface so that arm 102 diverts the flow of water outwardly as the boat moves forward. As best seen in FIG. 1A, arm 102 can come to a point at front end 100*a* such that there is little to no gap between arm 102 and the hull during use of wake enhancer 100. This will minimize the amount of water that may flow between wake enhancer 100 and the hull.

Sidewalls 103*a*, 103*b* extend between base 101 and arm 102 along the frontward region of base 101. In other words, sidewalls 103*a*, 103*b* extend in a lengthwise direction from front end 100*a* to approximately a midpoint between front end 100*a* and rear end 100*b* thereby forming side openings into the interior space between base 101 and arm 102. In this embodiment, sidewalls 103*a*, 103*b* include recessed (or inwardly curved) ends 103*a*1, 103*b*1 respectively. Recessed ends 103*a*1, 103*b*1 provide additional access into the interior of wake enhancer 100 without overly compromising the structural reinforcement that sidewalls 103*a*, 103*b* provide to arm 102. In some embodiments, base 101, arm 102, and sidewalls 103*a*, 103*b* can be molded as an integral structure to thereby enhance the structural integrity of wake enhancer 100.

Figure 1C:
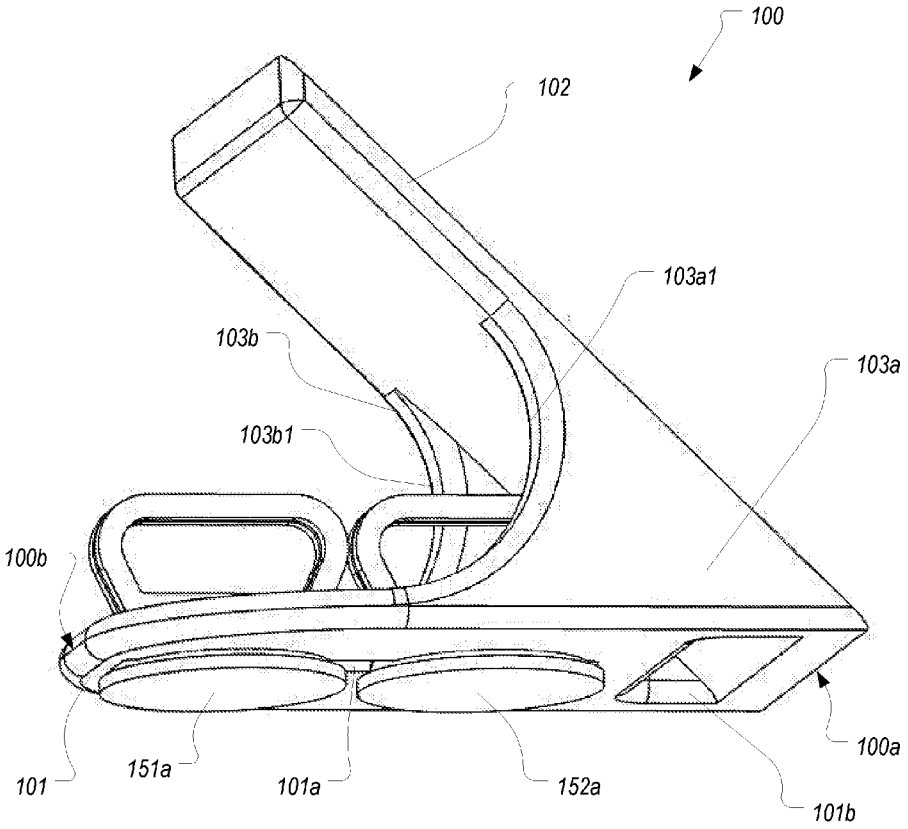
Figure 1D:
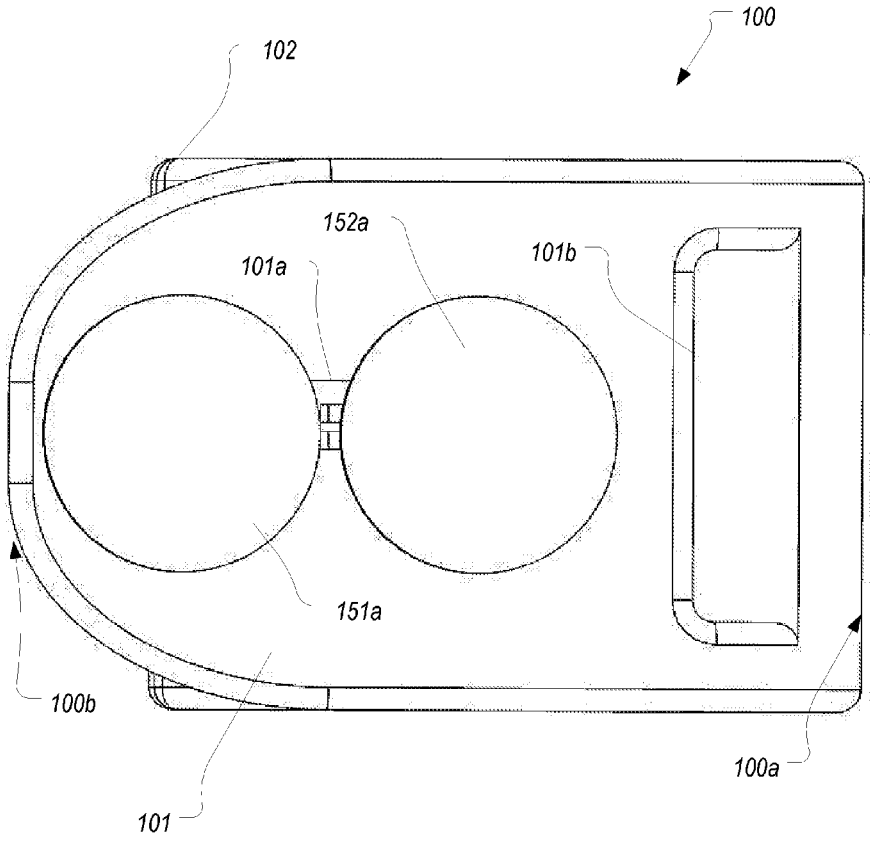

As is best seen in FIGS. 1C and 1D, base 101 can include a first opening (or openings) 101*a* and a second opening (or openings) 101*b* both of which pass entirely through base 101. Second opening 101*b* is positioned towards front end 100*a* and functions as a drain for water that may be present within the interior of wake enhancer 100 when wake enhancer 100 is being lifted from the water. For example, after wake enhancer 100 has been used, an individual may remove wake enhancer 100 from the hull and lift wake enhancer 100 from the water using handle 151*b* and/or 152*b*. During this process, water contained within the interior of wake enhancer 100 (i.e., within the area surrounded by base 101, arm 102, and sidewalls 103*a*, 103*b*) will be allowed to flow out through second opening 101*b* thereby facilitating the lifting of wake enhancer 100 into the boat. By forming this drain in base 101 as opposed to in another structure of wake enhancer 100, there will be little to no impact on the flow of water during use (i.e., second opening 101*b* will be substantially "hidden" from the flow of water).

First opening 101*a* extends lengthwise along a longitudinal axis of base 101 and serves as an opening through which handles and engagement levers of suction cup assemblies 151, 152 extend. First opening 101*a* is positioned towards rear end 100*b* so that suction cup assemblies 151, 152 will also be positioned towards rear end 100*b*. In this way, when water applies an inward force on arm 102 (e.g., an inward force perpendicular to arm 102), the inward force will be directed towards suction cup assemblies 151, 152 thereby reinforcing the coupling of wake enhancer 100 to the boat. In contrast, if suction cup assemblies 151, 152 were instead positioned towards front end 100*a* (or even in front of arm 102), the torsional force caused by the water may create a pivoting force at rear end 100*b* that may work against the suction force. Accordingly, it is preferable to position suction cup assemblies 151, 152 below the center of pressure from arm 102, normal to base 101, and towards rear end 100*b*.

Arm 102 is angled relative to the direction of water flow in such a way as to induce an inward force against suction cup assemblies 151, 152 that couple the device to the hull as mentioned above. Angling arm 102 in this manner minimizes the amount of torsional force that would otherwise be created if arm 102 were instead oriented perpendicular or nearly perpendicular to the direction of water flow (as well as to the hull). Accordingly, the orientation of arm 102 enhances the coupling between suction cup assemblies 151, 152 and the hull.

Figure 3:
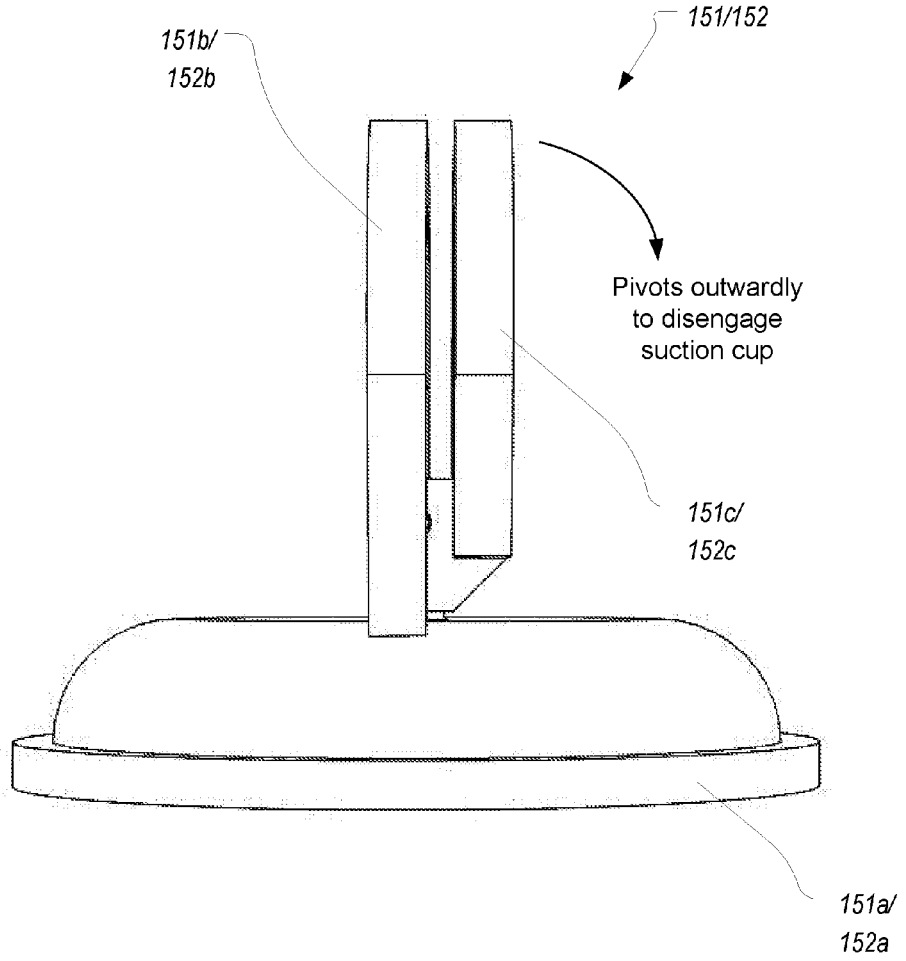
FIG. 3 illustrates a suction cup assembly that can be employed in the first and second embodiments of the wake enhancer.

As best shown in FIG. 3, each of suction cup assemblies 151, 152 can be similarly configured with three primary components: a suction cup 151*a*/152*a*, a handle 151*b*/152*b*, and an engagement lever 151*c*/152*c*. Although not shown, suction cup assemblies 151, 152 may include a housing positioned directly above suction cup 151*a*, 152*a* respectively that can be adhered to base 101 in a suitable manner (e.g., using a waterproof adhesive). Of course, other means for securing suction cup assemblies 151, 152 could also be employed.

Handle 151*b*/152*b* extends upwardly from suction cup 151*a*/152*a* (or from the housing when one is employed) and remains stationary with respect to base 101. In contrast, as represented by the arrow in FIG. 3, engagement lever 151*c*/152*c* is configured to pivot between an engaged position and a disengaged position. In FIG. 3, engagement lever 151*c*/152*c* is shown in the engaged position. Therefore, FIGS. 1A-1F each represent the orientation engagement levers 151*c*, 152*c* would be in when wake enhancer 100 is secured to the hull of a boat. Then, when it is desired to remove wake enhancer 100 from the hull, engagement levers 151*c*, 152*c* would be pivoted outwardly to disengage suction cups 151*a*, 152*a* thereby allowing wake enhancer 100 to be removed. Similarly, when it is again desired to couple wake enhancer 100 to the boat, wake enhancer 100 could be pressed against the hull while engagement levers 151*c*, 152*c* are in the outward (or disengaged) position. With an initial suction created to maintain wake enhancer 100 against the hull, engagement levers 151*c*, 152*c* could then be pivoted back to the engaged position. The transition of engagement levers 151*c*, 152*c* from the disengaged to the engaged position pulls the top of suction cups 151*a*, 152*a* away from the hull thereby increasing the suction against the hull. In this way, suction cups 151*a*, 152*a* can remain secured to the hull even when the boat is moving at high speeds.

First opening 101*a* is sized and configured to accommodate two suction cup assemblies. However, this need not be the case. In some embodiments, a wake enhancer may only include a single suction cup assembly or may include more than two suction cup assemblies. In any case, it may be desirable to include at least two suction cup assemblies to prevent wake enhancer 100 from rotating once secured to the hull. More specifically, if wake enhancer 100 only included a single suction cup assembly, it would be more likely to rotate around this single point of coupling. In contrast, with two points of coupling, it will be unlikely that wake enhancer 100 would rotate.

Figure 1E:
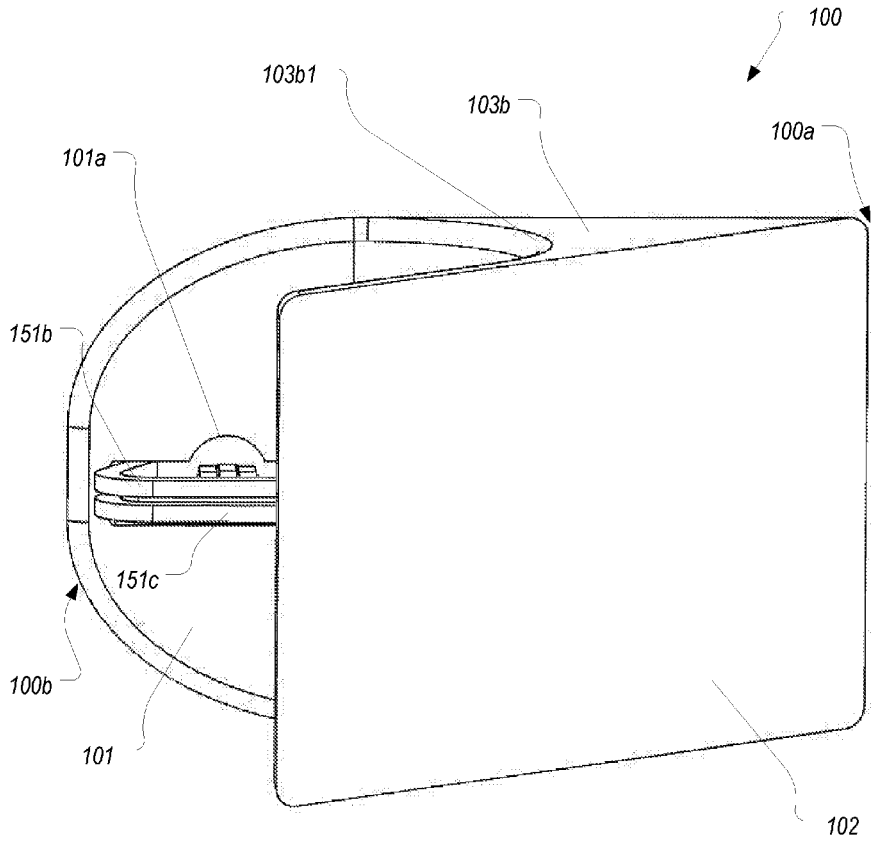
Figure 1F:
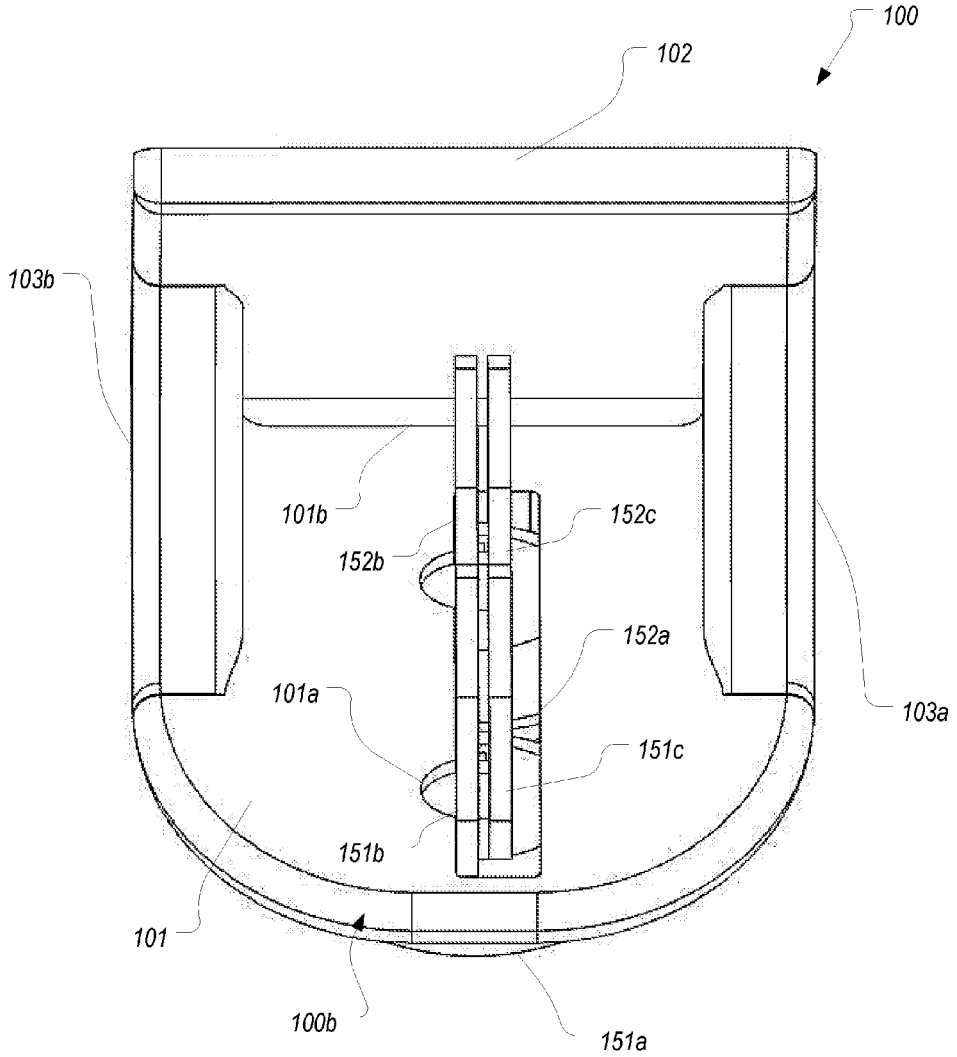

As may be best seen in FIG. 1E, the configuration of sidewalls 103*a*, 103*b* facilitate access to handles 151*b*, 152*b* and engagement levers 151*c*, 152*c*. Due to the forward positioning of sidewalls 103*a*, 103*b* as well as recessed ends 103*a*1, 103*b*1, a substantial opening is formed in each side of wake enhancer 100. Therefore, an individual can easily insert his or her hand through these side openings to grip the handles and engagement levers when coupling or decoupling wake enhancer 100.

Another benefit of forming sidewalls 103*a*, 103*b* with recessed ends 103*a*1, 103*b*1 is that it reduces the surface area of sidewalls 103*a*, 103*b* against which water may apply a force. More specifically, in some cases, wake enhancer 100 may be coupled to the boat at an angle relative to the water plane (i.e., so that sidewalls 103*a*, 103*b* are not parallel to the direction of water flow). In these cases, the reduced surface area of sidewalls 103*a*, 103*b* can minimize the amount of force that is applied against the sidewall which in turn should minimize any impact the angled orientation may have on the performance of wake enhancer 100.

As is shown in FIGS. 1A-1F, the corners and edges of wake enhancer 100 can be rounded to protect individuals and the boat during use. Also, in some embodiments, a rubberized coating may be applied to the entire unit or only to surfaces that are configured to come in contact with the boat (e.g., the bottom surface of base 101). Wake enhancer 100 can also be made of a buoyant material (e.g., a plastic) to prevent it from sinking.

Figure 2A:
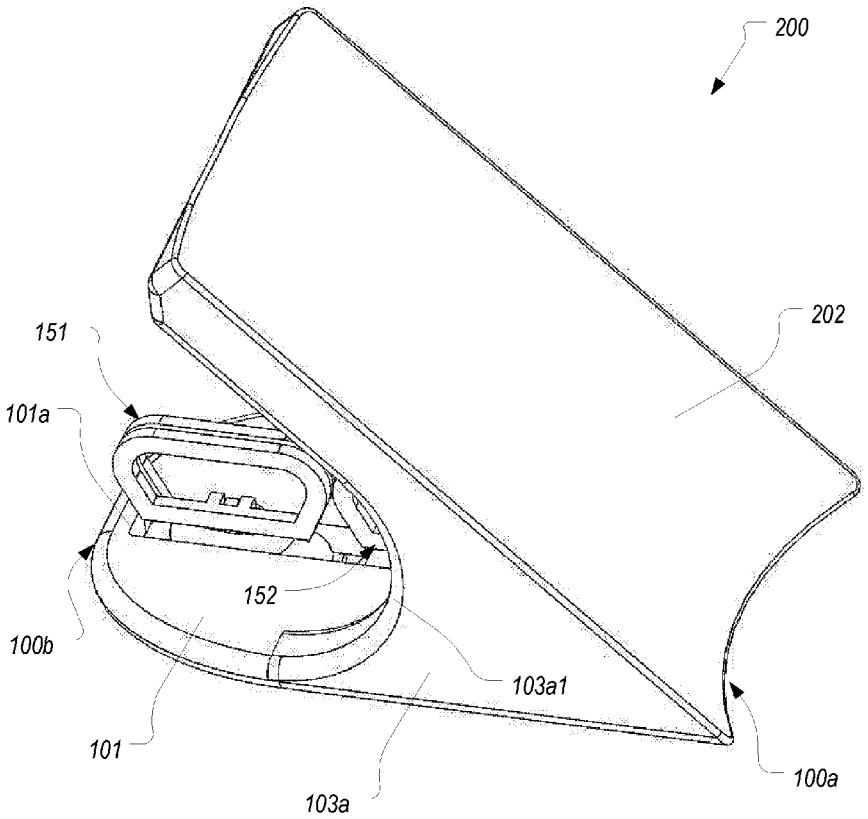
FIG. 2A-2F illustrate various views of a second embodiment of a wake enhancer.
Figure 2B:
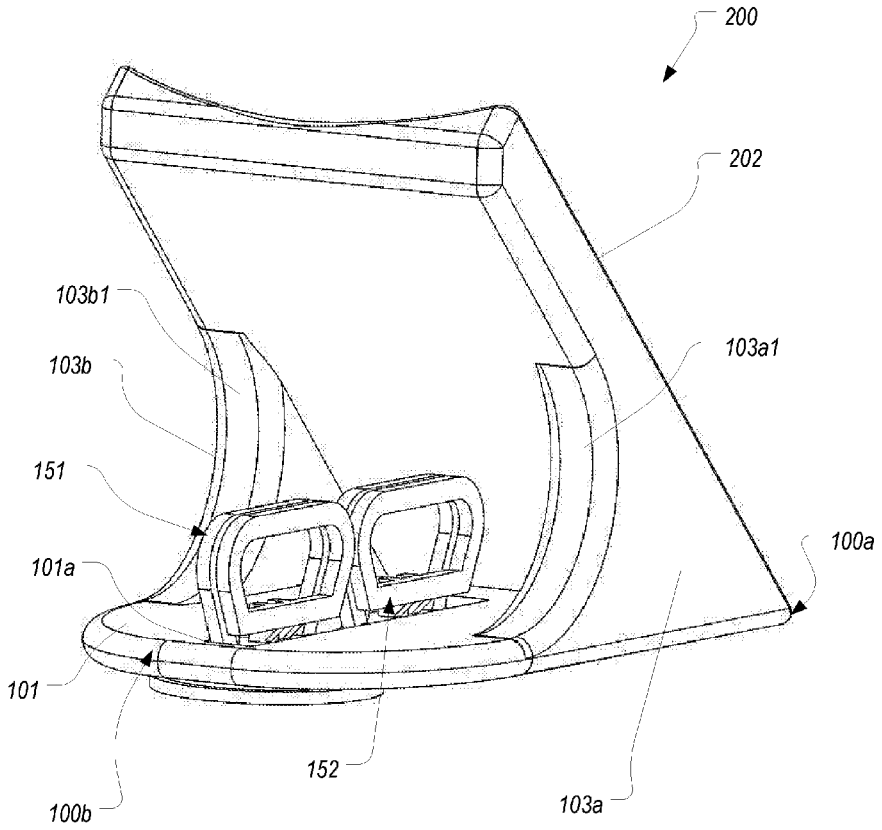
Figure 2C:
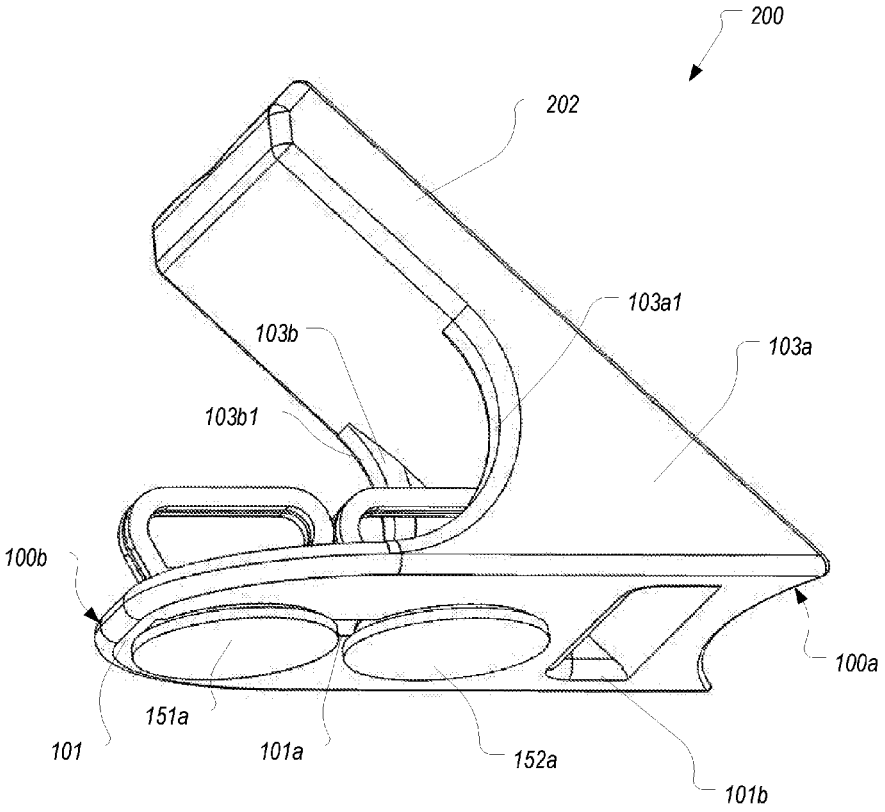
Figure 2D:
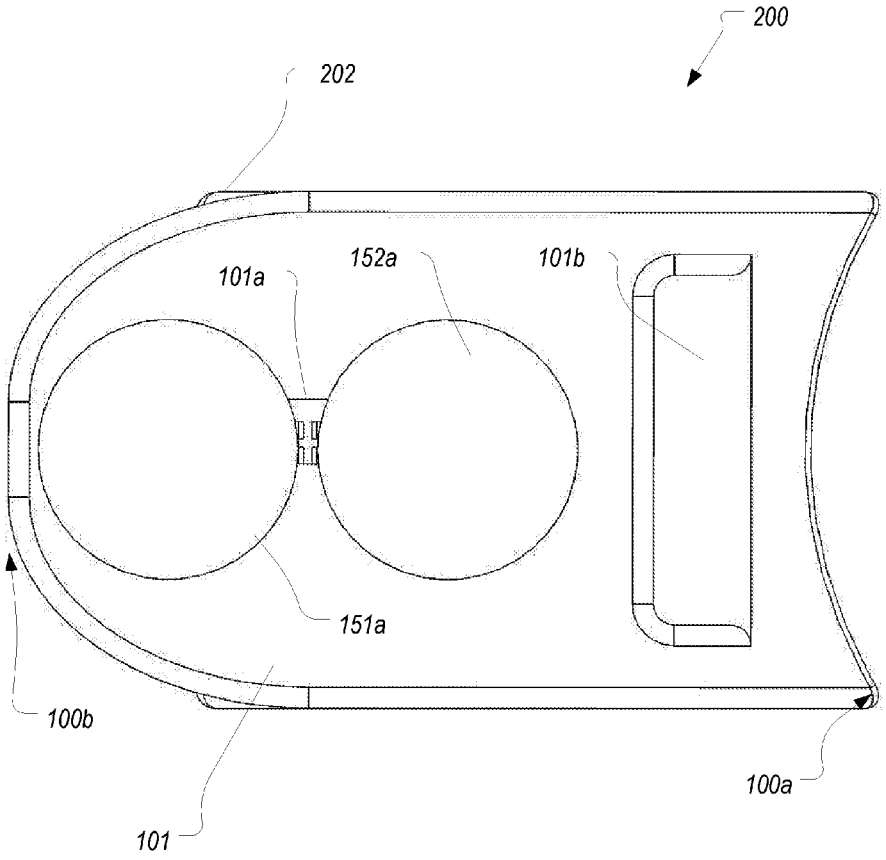
Figure 2E:
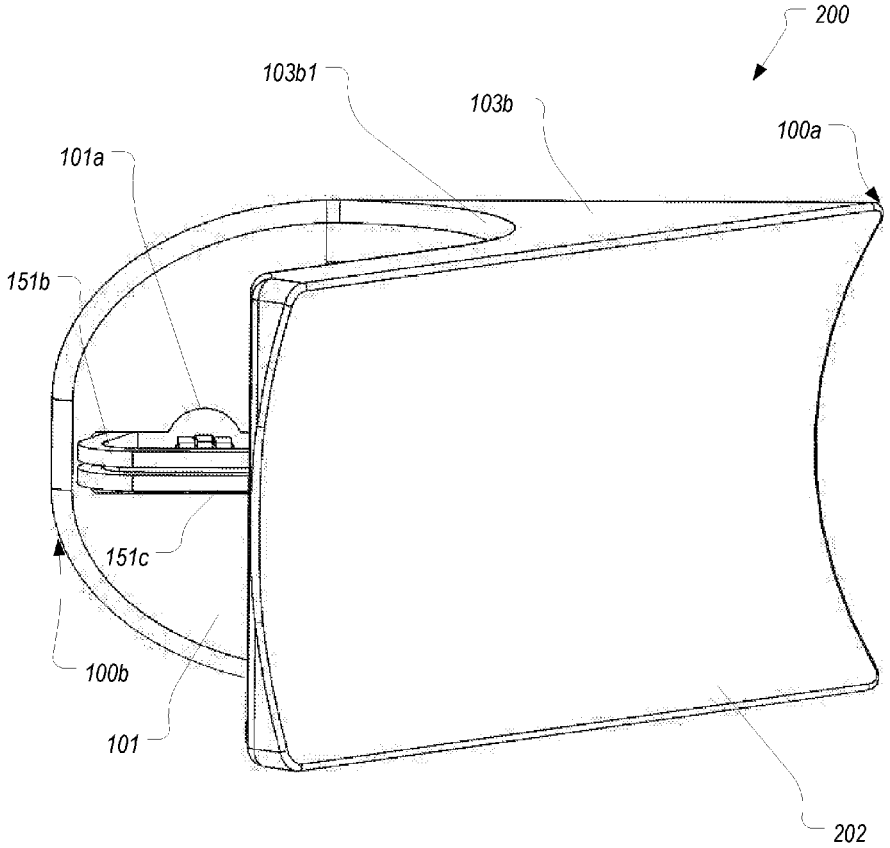
Figure 2F:
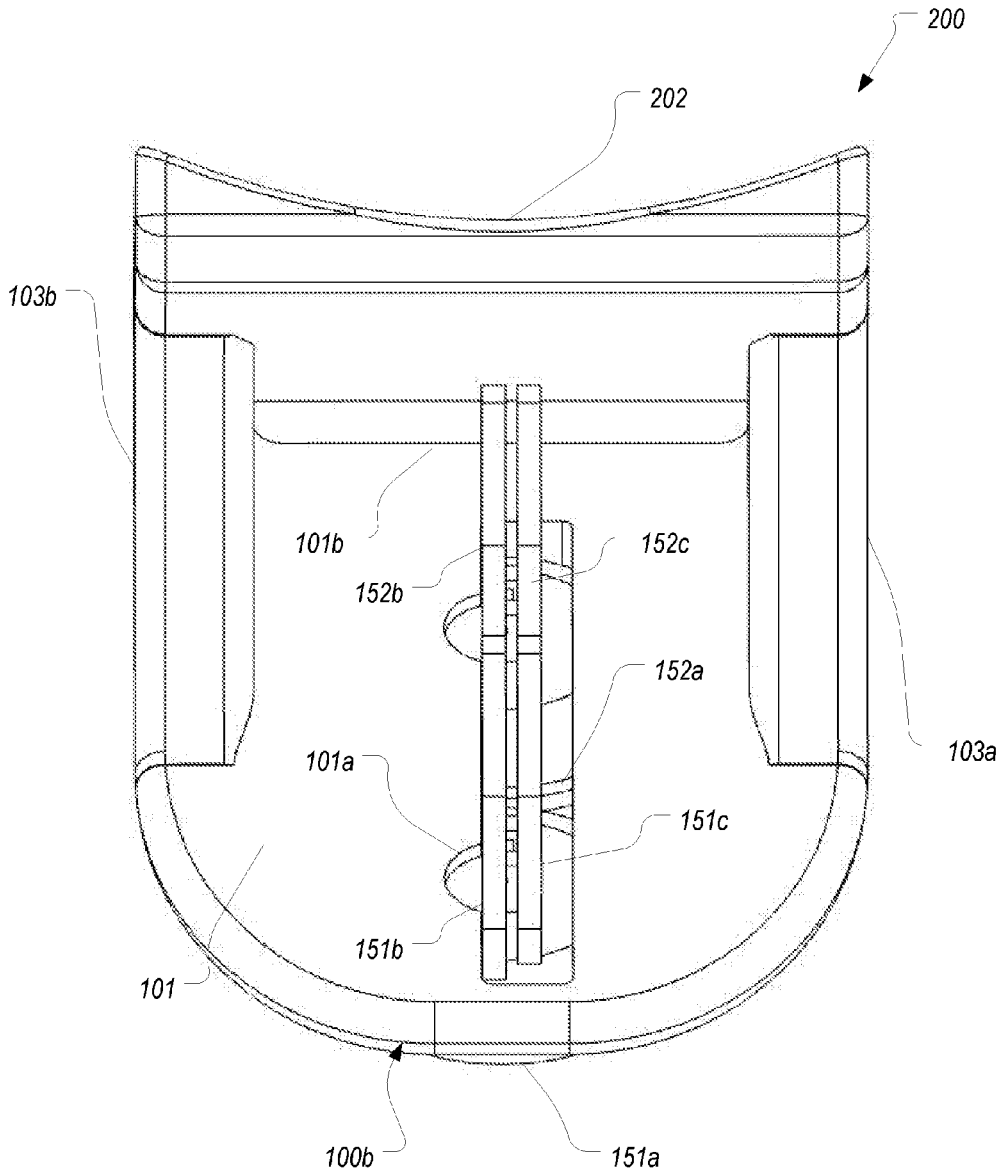

FIGS. 2A-2F illustrate a wake enhancer 200 that is configured in accordance with one or more embodiments of the present invention. Wake enhancer 200 can be configured substantially the same as wake enhancer 100 and therefore the above description of wake enhancer 100 can equally apply to wake enhancer 200. However, unlike wake enhancer 100, arm 202 of wake enhancer 200 has a concave or channeled face. For example, as best seen in FIG. 2F, the cross-sectional shape of arm 202 forms a shallow U. In some embodiments, the same cross-sectional shape may extend along the full length of arm 202, whereas in other embodiments, the cross-sectional shape may vary along the length. For example, the depth of the concavity may vary along the length such as by being deeper towards the rear of arm 202 or towards the front of arm 202.

In any case, by forming a channel within arm 202, wake enhancer 200 can more efficiently direct the flow of water outwardly away from the boat. Another benefit of arm 202 is that the channel allows fine tuning of a wake. More specifically, because of the channel, water will be more effectively diverted along arm 202. Therefore, by orienting wake enhancer 200 at an angle with respect to the water plane, the direction of water flow with respect to the boat and therefore the direction of force applied to the boat, can be fine-tuned without changing the relative position of wake enhancer 200 on the boat.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A wake enhancer comprising:
- a base having a front end and a rear end;
- an arm extending outwardly and rearwardly from the base, the arm forming a forward facing surface for diverting the flow of water when the wake enhancer is coupled to a boat;
- opposing sidewalls that extend between the base and the arm to provide support to the arm, the opposing sidewalls being positioned towards the front end of the base and extend lengthwise from the front end of the base to approximately a midpoint of the base; and
- one or more suction cup assemblies that are secured to the base and configured to couple the wake enhancer to a hull of a boat.

2. The wake enhancer of claim 1, wherein the opposing sidewalls include recessed ends.

3. The wake enhancer of claim 2, wherein the recessed ends are inwardly curved.

4. The wake enhancer of claim 1, wherein each suction cup assembly comprises:
- a suction cup that is positioned underneath the base;
- a handle that extends through the base; and
- an engagement lever that is coupled to the handle and pivots with respect to the handle between an engaged position and a disengaged position.

5. The wake enhancer of claim 4, wherein, when in the engaged position, the engagement lever is positioned alongside the handle, whereas, when in the disengaged position, the engagement lever is positioned away from the handle.

6. The wake enhancer of claim 1, wherein the base includes a drain opening.

7. The wake enhancer of claim 6, wherein the drain opening is positioned towards the front end of the base.

8. The wake enhancer of claim 1, wherein the arm has a substantially flat outer face.

9. The wake enhancer of claim 1, wherein the arm has an outer face that forms a concave channel.

10. The wake enhancer of claim 1, further comprising:
- a rubber coating on at least a bottom surface of the base.

11. The wake enhancer of claim 1, wherein the arm extends from the base at an angle between 40 and 50 degrees.

12. The wake enhancer of claim 1, wherein the suction cup assemblies are positioned towards the rear end of the base.

13. The wake enhancer of claim 1, wherein the base, the arm, and the opposing sidewalls are integrally molded.

14. A wake enhancer comprising:
- a base having a front end and a rear end;
- an arm extending outwardly and rearwardly from the base, the arm forming a forward facing surface for diverting the flow of water when the wake enhancer is coupled to a boat;
- opposing sidewalls that extend between the base and the arm to provide support to the arm; and
- one or more suction cup assemblies, each suction cup assembly comprising:
  - a suction cup positioned below the base;
  - a handle extending through the base; and
  - an engagement lever positioned above the base, the engagement lever configured to pivot with respect to the handle between and engaged and a disengaged position.

15. The wake enhancer of claim 14, wherein the base includes a drain opening positioned towards the front end of the base.

16. The wake enhancer of claim 15, wherein the drain opening is positioned between the front end and the one or more suction cup assemblies.

17. The wake enhancer of claim 14, wherein each opposing sidewall has a recessed end.

18. A wake enhancer comprising:
- a base having a front end and a rear end;
- an arm extending outwardly and rearwardly from the base, the arm forming a forward facing surface for diverting the flow of water when the wake enhancer is coupled to a boat;
- opposing sidewalls that extend between the base and the arm to provide support to the arm, the opposing sidewalls having recessed ends; and
- one or more suction cup assemblies, at least one of the suction cup assemblies being positioned rearwardly from the recessed ends, each suction cup assembly comprising:
  - a suction cup positioned below the base;
  - a handle extending through the base; and
  - an engagement lever positioned above the base, the engagement lever configured to pivot with respect to the handle between and engaged and a disengaged position.

19. The wake enhancer of claim 18, wherein the base includes a drain opening positioned towards the front end of the base.

20. The wake enhancer of claim 14, wherein the forward facing surface forms a concave channel.

21. The wake enhancer of claim 18, wherein the forward facing surface forms a concave channel.

* * * * *